US009856764B2

(12) United States Patent
Pegg et al.

(10) Patent No.: US 9,856,764 B2
(45) Date of Patent: Jan. 2, 2018

(54) CRANKCASE ASSEMBLY

(71) Applicant: Ford Global Technologies, LLC, Dearborn, MI (US)

(72) Inventors: Ian Graham Pegg, Chelmsford (GB); Roland Paul Stark, Hitchin (GB)

(73) Assignee: Ford Global Technologies, LLC, Dearborn, MI (US)

( * ) Notice: Subject to any disclaimer, the term of this patent is extended or adjusted under 35 U.S.C. 154(b) by 26 days.

(21) Appl. No.: 15/200,760

(22) Filed: Jul. 1, 2016

(65) Prior Publication Data

US 2017/0016365 A1 Jan. 19, 2017

(30) Foreign Application Priority Data

Jul. 14, 2015 (GB) ..... 1512257.5

(51) Int. Cl.
*F01M 1/04* (2006.01)
*F01M 9/10* (2006.01)
(Continued)

(52) U.S. Cl.
CPC ..... *F01M 9/105* (2013.01); *F01M 11/0004* (2013.01); *F02F 7/0043* (2013.01);
(Continued)

(58) Field of Classification Search
CPC ..... F01M 9/105; F01M 11/0004; F01M 2011/0037; F01M 2011/005; F01M 2011/0033; F02F 7/0043
(Continued)

(56) References Cited

U.S. PATENT DOCUMENTS 3,101,129 A * 8/1963 Hulten ..... F01M 11/00 184/106
5,038,890 A * 8/1991 Tanaka ..... F01M 11/0004 123/196 R
(Continued)

FOREIGN PATENT DOCUMENTS

GB 2437089 A 10/2007
GB 2524013 A 9/2015
(Continued)

OTHER PUBLICATIONS

Examination Report of Great Britain Patent Application No. 1512257.5, dated Dec. 31, 2015, 6 pages, United Kingdom Intellectual Property Office.
(Continued)

*Primary Examiner* — Hung Q Nguyen
(74) *Attorney, Agent, or Firm* — Greg Brown; McCoy Russell LLP

(57) ABSTRACT

A crankcase assembly for an engine is provided. The crankcase assembly includes a crankcase comprising a crank sump, the crank sump including a primary sump volume and a secondary sump volume, one or more crankcase oil catchers, the crankcase oil catchers comprising one or more surfaces configured to catch dispersed oil in the crankcase and direct the oil along the surfaces of the crankcase oil catcher away from a crankcase casing wall and towards the crank sump, wherein the crankcase oil catchers are provided above a crankshaft and below an associated piston of the engine, and one or more guides configured to collect oil captured by the crankcase oil catchers and guide the oil to the primary sump volume.

20 Claims, 5 Drawing Sheets

(51) Int. Cl.
*F01M 11/00* (2006.01)
*F02F 7/00* (2006.01)

(52) U.S. Cl.
CPC ..... *F01M 2011/005* (2013.01); *F01M 2011/0033* (2013.01); *F01M 2011/0037* (2013.01)

(58) Field of Classification Search
USPC ..... 123/195 C, 198 E, 196 R
See application file for complete search history.

(56) References Cited

U.S. PATENT DOCUMENTS 5,054,442 A * 10/1991 Pietsch ..... F02F 7/0048 123/195 H
5,092,291 A * 3/1992 Langlois ..... F01M 11/0004 123/196 R
5,103,782 A * 4/1992 Matsui ..... F01M 11/0004 123/195 C
5,456,227 A * 10/1995 Shimmell ..... F01M 11/0004 123/195 H
5,465,692 A * 11/1995 Uraki ..... F01M 11/0004 123/195 C
5,467,843 A * 11/1995 Esch ..... F01M 11/00 123/192.2
5,517,959 A 5/1996 Kato et al.
5,960,763 A * 10/1999 Yamamura ..... F01M 11/0004 123/195 C
6,530,354 B1 3/2003 Bishop et al.
6,820,585 B2 * 11/2004 Maeda ..... F01M 11/02 123/196 R
6,889,651 B2 * 5/2005 Tanaka ..... F01M 1/02 123/196 R
6,941,923 B2 * 9/2005 Saito ..... F01M 11/0004 123/195 C
7,341,039 B1 * 3/2008 Jaszewski ..... F01M 11/0004 123/195 AC
7,516,728 B1 * 4/2009 Staley ..... F01M 11/0004 123/195 C
8,302,577 B2 * 11/2012 Wunsch ..... F01M 11/0004 123/195 C
9,670,803 B2 * 6/2017 Pegg ..... F01M 11/0004
2003/0029412 A1 * 2/2003 Kato ..... F01M 5/02 123/195 C
2004/0177826 A1 * 9/2004 Duwel ..... F01M 11/0004 123/196 R
2005/0279316 A1 * 12/2005 Rice ..... F01M 11/0004 123/195 C
2009/0277416 A1 11/2009 Saito
2012/0067319 A1 * 3/2012 Cygan, Jr. ..... F01M 11/0004 123/196 A
2014/0096738 A1 * 4/2014 Kurihara ..... F01M 1/04 123/196 R
2015/0252697 A1 * 9/2015 Pegg ..... F01M 11/0004 123/41.42
2015/0322888 A1 11/2015 Pegg et al.

FOREIGN PATENT DOCUMENTS

JP 61185609 A * 8/1986 ..... F01M 11/00
JP 05187215 A * 7/1993
JP 2006189002 A 7/2006
JP 2006242025 A 9/2006
JP 2006242052 A 9/2006
JP 2007303371 A * 11/2007
JP 2008025369 A 2/2008
JP 2008208736 A 9/2008
JP 2010084536 A 4/2010
JP 2010190044 A 9/2010
JP 2013204480 A 10/2013

OTHER PUBLICATIONS

Pegg, Ian Graham, et al., "Crankcase Oil Catcher," U.S. Appl. No. 14/624,177, filed Feb. 14, 2015, 31 pages.
Chisaki, Junji, et al., "Development of a New 2.0-Liter Fuel-Efficient Diesel Engine," SAE Technical Paper 2013-01-0310, Toyota Motor Corporation.
Higashitani, Masuru, et al., "Dual-Chamber Oil Pan for Improved Engine Warm-Up Performance," Development Thermal Management, MTZ, vol. 73, pp. 54-57, Dec. 2012, 4 pages.

* cited by examiner

CRANKCASE ASSEMBLY

CROSS REFERENCE TO RELATED APPLICATION

This application claims priority to Great Britain Patent Application No. 1512257.5, filed Jul. 14, 2015, the entire contents of which are hereby incorporated by reference for all purposes.

BACKGROUND/SUMMARY

During warm up of an internal combustion engine, the engine block structure acts as a large heat sink because the thermal inertia of the engine block structure is an order of magnitude greater than the coolant and oil. As a result, the engine block structure takes longer to warm up than the oil.

By way of example, hot oil returning from a piston cooling gallery, which has been heated by the combustion events, may hit a crank of the engine and the oil may be thrown against the cooler crankcase. When the oil is thrown against the crankcase wall, the oil loses heat due to the large thermal inertia of the crankcase and the large surface area of the crankcase. Similarly, oil returning from the cylinder head has been heated and loses heat as it returns through the engine block to the oil sump. The resulting colder oil has a higher viscosity, which leads to higher friction losses. This in turn leads to worse fuel consumption and cabin heating.

As such in one approach, a crankcase assembly for an engine is provided. The crankcase assembly includes a crankcase comprising a crank sump, the crank sump including a primary sump volume and a secondary sump volume, one or more crankcase oil catchers, the crankcase oil catchers comprising one or more surfaces configured to catch dispersed oil in the crankcase and direct the oil along the surfaces of the crankcase oil catcher away from a crankcase casing wall and towards the crank sump, wherein the crankcase oil catchers are provided above a crankshaft and below an associated piston of the engine, and one or more guides configured to collect oil captured by the crankcase oil catchers and guide the oil to the primary sump volume.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
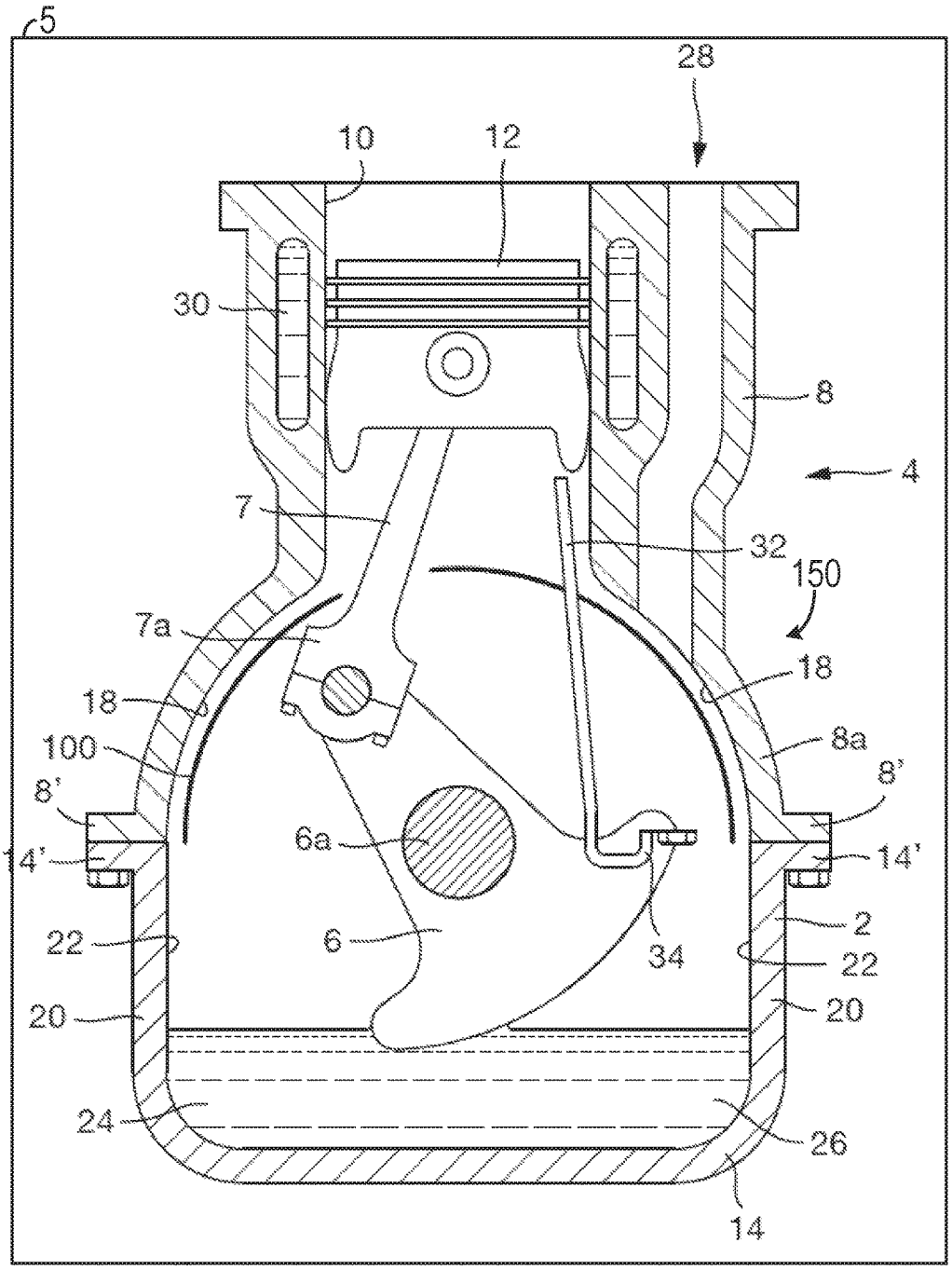
FIG. 1 shows a side sectional view of an engine in which there is provided a crankcase oil catcher according to an example of the present disclosure.

The present disclosure relates to a crankcase assembly. In one example, the crankcase assembly can include an oil catcher configured to catch dispersed oil in a crankcase and direct the oil towards a crank sump and away from a crankcase casing wall.

In one example, a crankcase assembly for an engine, such as an internal combustion engine is provided. The crankcase assembly can include a crankcase comprising a crank sump; the crank sump comprising a primary sump volume and a secondary sump volume, one or more crankcase oil catchers, the crankcase oil catchers comprising one or more surfaces configured to catch dispersed oil in the crankcase and direct the oil along the surfaces of the crankcase oil catcher away from a crankcase casing wall and towards the crank sump, wherein the crankcase oil catchers are provided above a crankshaft and below an associated piston of the engine, and one or more guides or channels configured to collect oil captured by the crankcase oil catchers and guide the oil to the primary sump volume.

In another example, the guides may extend in a direction parallel to a longitudinal axis of the crankshaft.

In another example, the crankcase assembly may include a plurality of crankcase oil catchers, e.g., one for each cylinder and piston of the engine. The guides may extend across one or more of the plurality of crankcase oil catchers, for example the guides may extend across a subset of the crankcase oil catchers and not all of the crankcase oil catchers. Alternatively, the guides may extend across the plurality of crankcase oil catchers, e.g., all of the crankcase oil catchers. In another example, one or more first crankcase oil catchers may guide oil directly into the primary sump volume, e.g., without requiring the one or more guides. By contrast, one or more second crankcase oil catchers may be provided above the secondary sump volume and the guides may extend across the second crankcase oil catchers so as to direct oil into the primary volume.

In yet another example, the guides may be provided beneath a bottom edge of the crankcase oil catchers. Oil falling from the bottom edge of the crankcase oil catchers may drop onto the guides. The crankcase assembly may include a pair of guides with one guide either side of the crankshaft.

In a further example, the guides may be integral with or separate from a wall dividing the primary and secondary sump volumes.

In another example, the guides may include one or more openings configured to allow hot oil to pass through to the secondary sump volume beneath. The openings may be sized such that oil does not pass through openings when the oil is below a threshold temperature. The openings may be formed from a mesh or perforations.

In another example, oil may be returned to the primary sump volume during warm-up of the engine. Restricting the initial volume of the sump may increase the rate at which the engine warms up.

In another example, the crankcase assembly may further include a valve provided between the primary and secondary sump volumes. The valve may be configured to selectively permit the flow of oil between the primary and secondary sump volumes, e.g., in response to a signal from a controller.

In another example, an oil pump may be provided in or above the secondary sump volume such that leakage from the oil pump may collect in the secondary sump volume. An oil pump pick-up may be provided in the primary sump volume to collect oil from the primary sump volume for an oil pump.

In yet another example, the crankcase oil catcher may be configured to be provided above a crankshaft. The crankcase oil catcher may be configured to be provided below an associated piston. The crankcase oil catcher may be provided beneath an engine cylinder. The crankcase oil catcher may include a first aperture for a connecting rod to pass through. The width of the first aperture in a direction perpendicular and/or parallel to a longitudinal axis of the crankshaft may be smaller than the corresponding width of the associated engine cylinder.

In another example, the crankcase oil catcher may include a first lip provided around an edge defining the first aperture. The first lip may protrude form a top surface of the crankcase oil catcher. The first lip may protrude in a direction towards the piston.

In an additional example, the crankcase oil catcher may include a second aperture for a piston cooling jet to pass through or for receiving a duct for delivering a piston cooling jet. As for the first aperture, a lip may be provided around an edge defining the second aperture.

In yet another example, the crankcase oil catcher may be configured to be spaced apart from the crankcase casing wall. The crankcase oil catcher may be configured to substantially follow the contour of the crankcase casing wall. The crankcase oil catcher may be configured to substantially follow the contour of the crankcase casing wall in a plane perpendicular to a longitudinal axis of the crankshaft extending through the crankcase. A gap between the crankcase casing wall and the crankcase oil catcher may be between approximately 4 and 10 mm.

In an additional example, the crankcase oil catcher may be configured to be provided for a single cylinder of an engine. In other words, one crankcase oil catcher may be provided per piston. The crankcase oil catcher may be configured to be provided between walls between neighboring cylinders of an engine. However, it is also envisaged that the crankcase oil catcher may extend beneath a plurality of pistons.

In another example, the crankcase oil catcher may include a bottom surface. The bottom surface may face the crankshaft. The bottom surface may be configured to catch oil dispersed by a crankshaft, by a connecting rod and/or by a bearing between the crankshaft and the connecting rod. The crankcase oil catcher may include a top surface. The top surface may face the piston. The top surface may be configured to catch oil returning from above the crankcase, e.g., from a piston cooling gallery, a cylinder head or any other source of oil.

In an additional example, the crankcase oil catcher may include one or more second lips. The second lips may be provided on one or more edges of the crankcase oil catcher surfaces, e.g., on top and/or bottom surfaces of the crankcase oil catcher. The second lips may protrude above the top surface and/or below the bottom surface. The one or more second lips may be provided on edges of the crankcase oil catcher surfaces adjacent to the walls between neighboring cylinders of the engine. The one or more second lips may be provided on edges of the crankcase oil catcher surfaces substantially perpendicular to a longitudinal axis of a crankshaft extending through the crankcase.

In another example, the crankcase oil catchers and/or guides may be made from a thermally insulating material. For example, the crankcase oil catchers and/or guides may be made at least in part from a plastic material, such as nylon. The crankcase oil catchers and/or guides may be connected to the crankcase casing wall via one or more thermally insulating couplings. Such couplings may be made from a plastic material, e.g., nylon.

In an additional example, an engine, such as an internal combustion engine, may include the above-mentioned crankcase assembly and/or crankcase oil catcher. Similarly, a vehicle, such as an automobile, van or any other motor vehicle, may include the above-mentioned engine, crankcase assembly and/or crankcase oil catcher.

Figure 2:
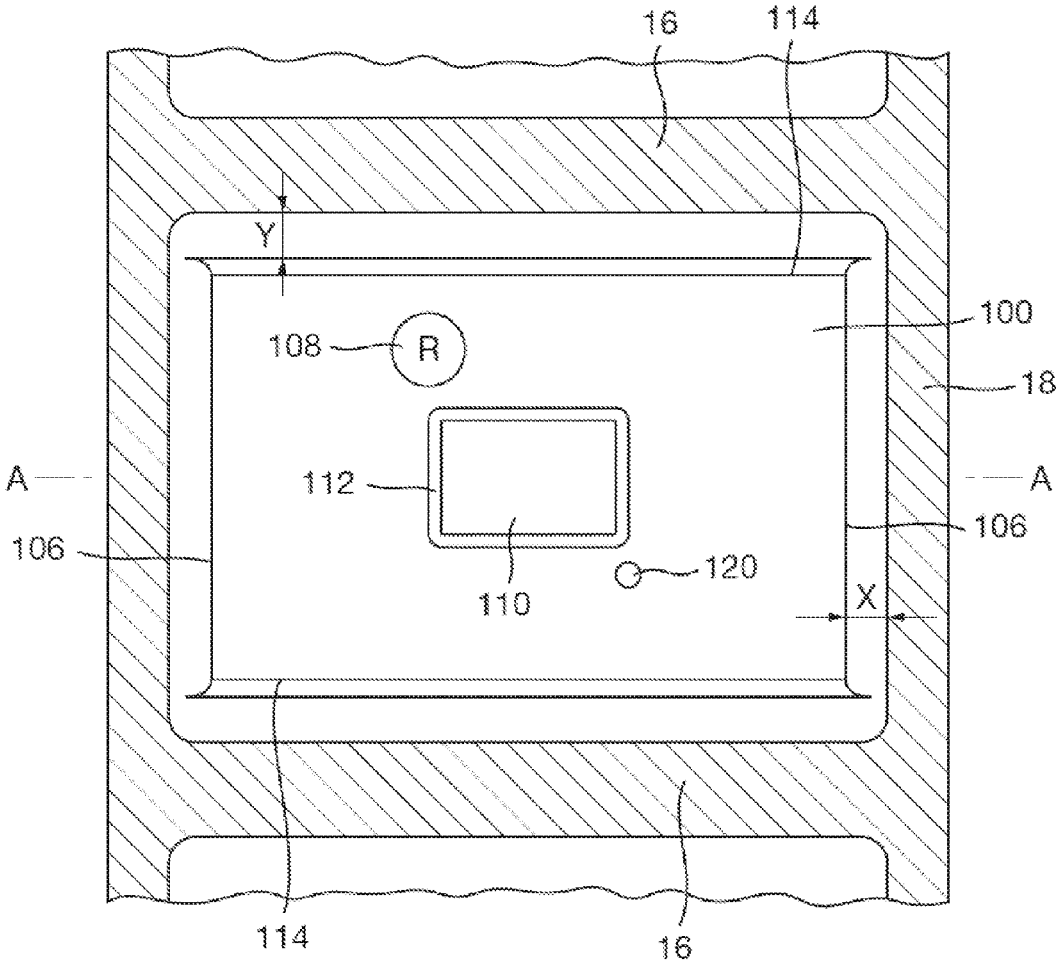
FIG. 2 shows a plan view of the crankcase oil catcher depicted in FIG. 1 (the crankshaft and connecting rod have been omitted for the sake of clarity)
Figure 3:
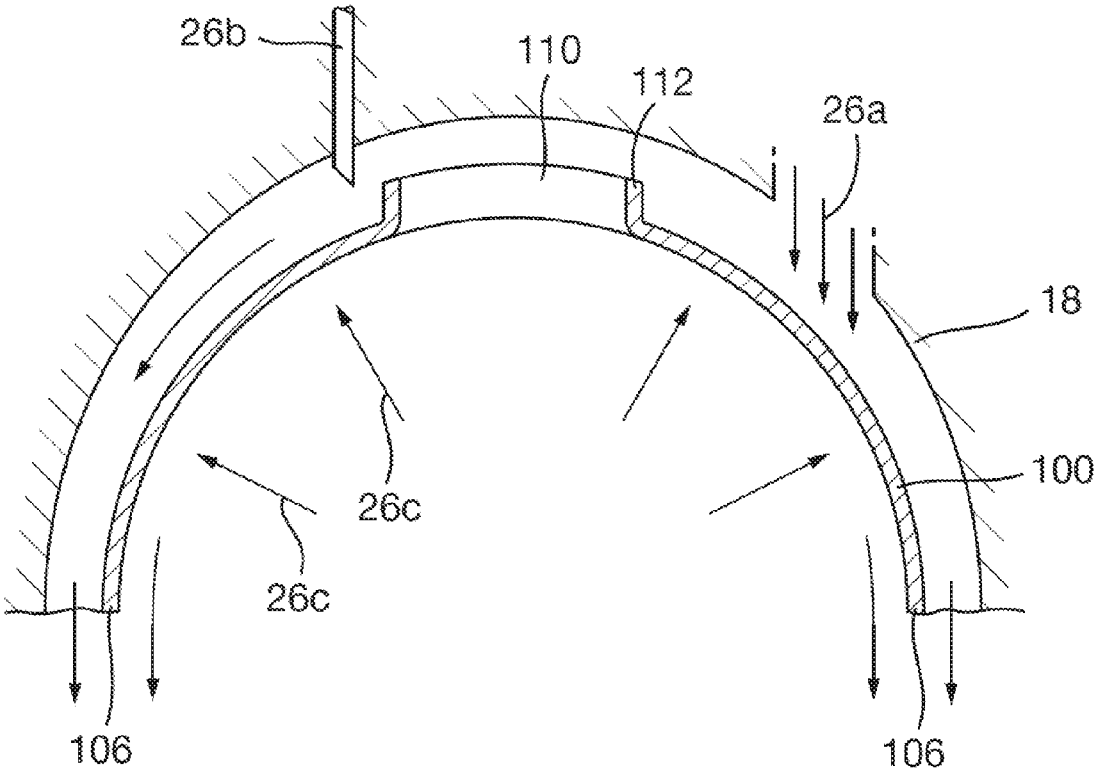
FIG. 3 shows a further side sectional view of the crankcase oil catcher depicted in FIG. 1 and is taken along section A-A shown in FIG. 2 (the crankshaft and connecting rod have been omitted for the sake of clarity)

With reference to FIGS. 1 to 3, a crankcase assembly 150 including one or more crankcase oil catchers 100 is illustrated. The crankcase oil catcher 100 is configured for placement in a crankcase 2 of an internal combustion engine 4 in a motor vehicle 5. The crankcase 2 forms a housing for a crankshaft 6 of the engine. As depicted, the crankcase 2 may include a portion 8*a* of a cylinder block 8, the portion 8*a* extending below cylinders 10 for pistons 12. The crankcase 2 is completed by a sump portion 14, which may be coupled to the cylinder block portion 8*a* via flanges 8', 14'. Although not shown, it will be appreciated that other arrangements may apply, for example, the crankcase and cylinder block may be integral or the crankcase and cylinder block may be separate discrete components.

As is depicted in FIG. 1, the crankcase oil catcher 100 is provided above the crankshaft 6 and below the pistons 12. Accordingly, the crankcase oil catcher is provided beneath the engine cylinders 10. Furthermore, as is shown in FIG. 2, the crankcase oil catcher 100 may be provided between walls 16. The walls 16 divide neighboring cylinders 10 and may extend below the cylinders 10 into the crankcase 2. The walls 16 may provide supports for crankshaft bearing housings (not shown) and may be part of the cylinder block casting 8. Accordingly, one crankcase oil catcher 100 may be provided per cylinder 10 and associated piston 12. However, in alternative arrangements, the crankcase oil catcher may extend over any number of cylinders 10.

The crankcase oil catcher 100 may be spaced apart from an inner surface 18 of the crankcase 2. The inner surface 18 may be towards the top of the crankcase 2 and, in the particular example shown, the inner surface 18 may be provided on the portion 8*a* of cylinder block 8 that extends below cylinders 10. The crankcase oil catcher 100 may be substantially planar, e.g., plate-like, for example, with a thickness that is less than 1% of its length or width.

The crankcase oil catcher 100 may lie in a plane that at least partially follows the contours of the inner surface 18 of the crankcase 2. As a result, the crankcase oil catcher 100 may be substantially parallel to the inner surface 18. The inner surface 18 and thus crankcase oil catcher 100 may trace out one or more arcs of a circle in a plane perpendicular to the crankshaft longitudinal axis 6*a*. The center of the circle may substantially correspond to the longitudinal axis 6*a* of the crankshaft, e.g., the axis about which the crankshaft rotates. By contrast, the inner surface 18 and thus crankcase oil catcher 100 may be substantially straight in a direction parallel to the crankshaft longitudinal axis 6*a*. In such an example, the crankcase oil catcher 100 may be formed as a section of a substantially cylindrical tube.

The crankcase oil catcher 100 may fit in a space between the crankcase inner wall 18 and an arc traced out by crankshaft 6 and a big end 7*a* of connecting rod 7 as the crankshaft 6 rotates. As depicted in FIG. 2, a gap X, e.g., in a radial direction, may exist between the crankcase casing wall 18 and the crankcase oil catcher 100. Gap X may vary or may be substantially constant, e.g., along the surface of the crankcase oil catcher. Gap X may be between approximately 4 and 10 mm. Similarly, a gap Y may exist between the dividing walls 16 and the crankcase oil catcher 100. Gap Y may be substantially constant. Gap Y may be small, e.g., between approximately 1 and 10 mm.

As shown in FIG. 1, sump walls 20 with inner facing sump surfaces 22 may be provided below the curved inner surface 18 of the crankcase 2. The sump walls 20 may be provided either side of the crankshaft 6. The sump surfaces 22 may be substantially straight and parallel. The sump surfaces 22 may be coincident with a tangent of the inner surface 18 at the interface between the sump surfaces 22 and inner surface 18. The sump walls 20 may form part of the sump portion 14, which may or may not be integral with casing potion 8*a*. The sump walls 20 may define a sump 24 which contains the oil 26 in the crankcase 2.

Referring to FIG. 1, the crankcase oil catcher 100 may extend downwards to a point substantially level with the crankshaft longitudinal axis 6*a*. Specifically in one example, the crankcase oil catcher 100 may substantially trace out an arc of a circle centered about the crankshaft longitudinal axis 6*a*, the crankcase oil catcher 100 may subtend an angle of approximately 180°. However, in alternative arrangements the crankcase oil catcher may extend to a point above the crank longitudinal axis, e.g., the crankcase oil catcher 100 may subtend an angle of less than 180°. This may be advantageous since oil running off the oil catcher 100 may be spaced further from sump surfaces 22 as the oil falls into the sump 24. Alternatively, the crankcase oil catcher may extend to a point below the crank longitudinal axis. For example, the crankcase oil catcher may follow the sump surfaces 22, which may as depicted be substantially straight. The crankcase oil catcher may even extend into the oil sump 24, e.g., below the oil level during use.

The crankcase oil catcher 100 includes surfaces, which are configured to catch oil dispersed in the crankcase 2 and direct the oil along the surfaces of the crankcase oil catcher away from the crankcase walls 18, 22 and towards the crank sump 24. In particular, the crankcase oil catcher 100 includes a top surface 102, which when installed faces the piston 12. Furthermore, the crankcase oil charger 100 includes a bottom surface 104, which when installed faces the crankshaft 6.

Referring to FIGS. 2 and 3, the crankcase oil catcher 100 may include a first aperture 110 for the connecting rod 7 to pass through. The width of the first aperture 110 in a direction perpendicular to the longitudinal axis 6*a* of the crankshaft may be smaller than the corresponding width of the associated engine cylinder 10. Additionally or alternatively, the width of the first aperture 110 in a direction parallel to the longitudinal axis 6*a* of the crankshaft may be smaller than the corresponding width of the associated engine cylinder 10. As a result, oil falling down the side of cylinder 10 will be caught by the crankcase oil catcher 100.

As shown in FIG. 3, the crankcase oil catcher 100 may include a first lip 112 provided around an edge defining the first aperture 110. The first lip 112 may protrude from the top surface 102 of the crankcase oil catcher and may protrude in a direction towards the piston 12. The first lip 112 may prevent oil on the top surface 102 from falling through the first aperture 110.

As shown in FIG. 2, the crankcase oil catcher 100 may include a pair of second lips 114. The second lips 114 may be provided on edges of the crankcase oil catcher that are adjacent to the walls 16 between neighboring cylinders 10. Accordingly, the second lips 114 may be provided on the two edges of the crankcase oil catcher that are substantially perpendicular to the crankshaft longitudinal axis 6*a*. The second lips 114 may protrude above the top surface 102. As a result, the second lips 114 may prevent oil on the top surface 102 from falling over the edge adjacent to walls 16.

As depicted in FIGS. 1 and 2, the crankcase oil catcher 100 may include a second aperture 120 for a piston cooling jet 32 to pass through. The piston cooling jet 32 may be delivered from an oil duct 34 which directs the jet of oil 32 through the second aperture 120 and towards the piston 12. Alternatively, the duct for delivering the cooling jet 32 may extend through the second aperture 120. As for the first aperture 110, an upwardly projecting lip (not shown) may be provided around an edge defining the second aperture 120.

Referring to FIGS. 1 and 3, the top surface 102 may be configured to catch oil returning from above the crankcase, such as oil 26*a* returning from a cylinder head through passage 28 and/or oil 26*b* returning from the cylinder 10, e.g., from a piston cooling gallery 30 disposed about the cylinder 10. Accordingly, the crankcase oil catcher 100 may extend over the cylinder head oil drain passage 28 and/or a piston cooling gallery drain passage (not shown). For example, oil returning from the piston cooling gallery 30 may flow onto the top surface 102 at a point 108 on the top surface. Oil collected on the top surface 102 may then flow along the top surface by virtue of gravity. The oil may flow until it reaches a bottom edge 106 of the crankcase oil catcher 100 at which point the oil falls into the sump 24.

The bottom surface 104 may be configured to catch oil 26*c* dispersed by the crankshaft 6 and/or by the connecting rod big end 7*a*, e.g., as they pass through the oil 26 in the sump 24. Oil collected on the bottom surface 104 may then flow along the bottom surface by virtue of gravity and the oil's surface tension. The oil may flow until it reaches the bottom edge 106 of the crankcase oil catcher 100 at which point the oil falls into the sump 24.

In either case, the top and bottom surfaces 102, 104 may prevent oil returning to the sump 24 from contacting the crankcase walls 18, 16, 20, thereby decreasing (e.g., minimizing) the heat lost by the oil to the crankcase 2. Furthermore, oil returning from above the crankcase may be prevented from simply falling directly into the crankcase, hitting the crankshaft or connecting rod and being flung out to the casing walls.

In addition, the crankcase oil catcher 100 and the air gap between the crankcase oil catcher 100 and crankcase inner surface 18 will act as thermal insulation barrier. The motion of the crankshaft 6 and connecting rods 7 creates a rotating flow of gas with an oil mist in the crankcase. Such a flow results in additional heat loss due to forced convection from the hot gases to the colder crankcase wall. Therefore, by adding the oil catcher 100 and the air gap between it and the inner surface 18, the amount of conduction and forced heat convection from the gas motion, as well as heat loss from the hot oil, will be reduced.

The crankcase oil catcher 100 may be molded or bent into shape during construction. Furthermore, the crankcase oil catcher 100 may be made from a low conducting thermally insulating material, for example, a plastic material, such as nylon. The selection of such a material would decrease (e.g., minimize) the thermal energy transferred from the oil falling on the crankcase oil catcher 100. In addition, although not shown, the crankcase oil catcher may be connected to the crankcase casing wall 18 via one or more thermally insulating couplings and such couplings may be made from a plastic material, e.g., nylon. The couplings may include a fir tree type fitting, screws or any other suitable coupling. The couplings may be received in openings in the crankcase wall 18. The crankcase oil catcher may additionally or alternatively include flanges (not shown), which may for example fit between flanges 8', 14' of the cylinder block portion 8*a* and sump portion 14 to hold the crankcase oil catcher in place.

Figure 4:
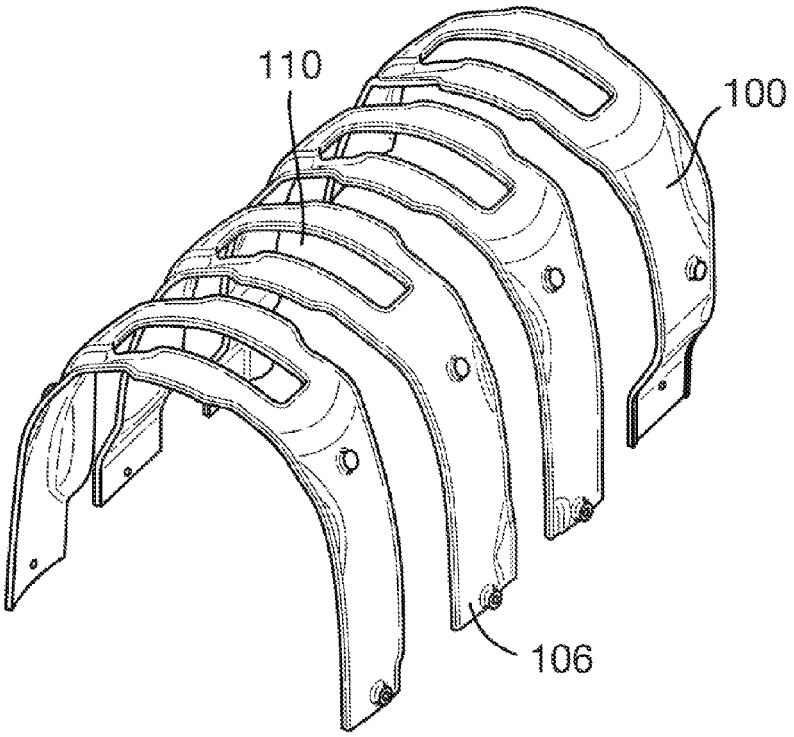
FIG. 4 shows a perspective view of four crankcase oil catchers aligned in an installed configuration according to a further example of the present disclosure (the engine has been omitted)
Figure 5:
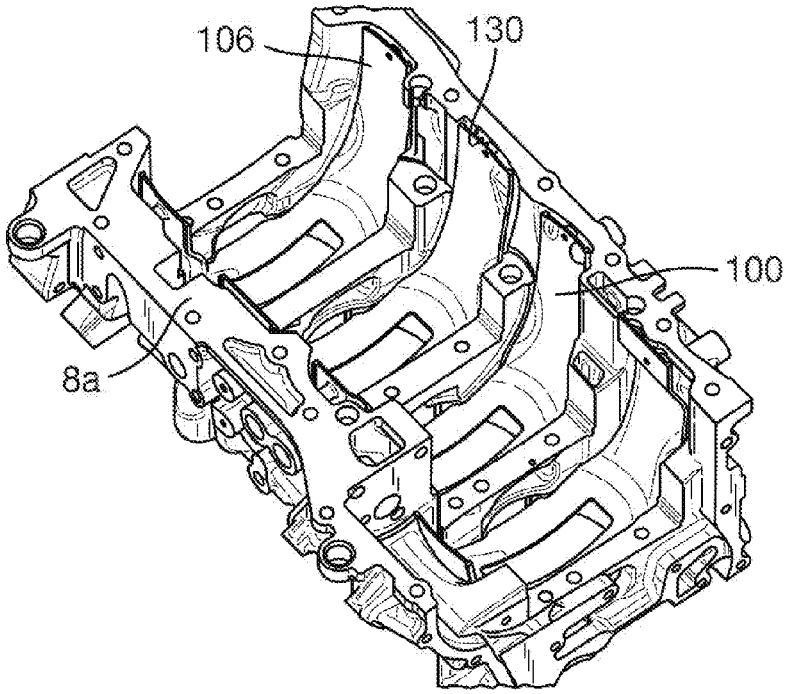
FIG. 5 shows a perspective view of the underside of the four crankcase oil catchers depicted in FIG. 4 installed into a crankcase of the engine.

With reference to FIGS. 4 and 5, a plurality of crankcase oil catchers 100 may be provided, for example with one crankcase oil catcher for each cylinder of the engine. In the particular example shown, four crankcase oil catchers 100 may be provided for an engine comprising four cylinders arranged in line.

FIG. 5 shows the crankcase oil catchers 100 depicted in FIG. 4 installed into the cylinder block portion 8*a* of the crankcase 2 of the engine. FIG. 5 shows an underside of crankcase oil catchers 100. As mentioned above, gaps 130 may be provided between crankcase inner surface 18 and the bottom edge 106 of the crankcase oil catchers 100. Oil captured by the crankcase oil catchers 100 may flow through the gaps 130 to the sump portion 14.

Figure 6:
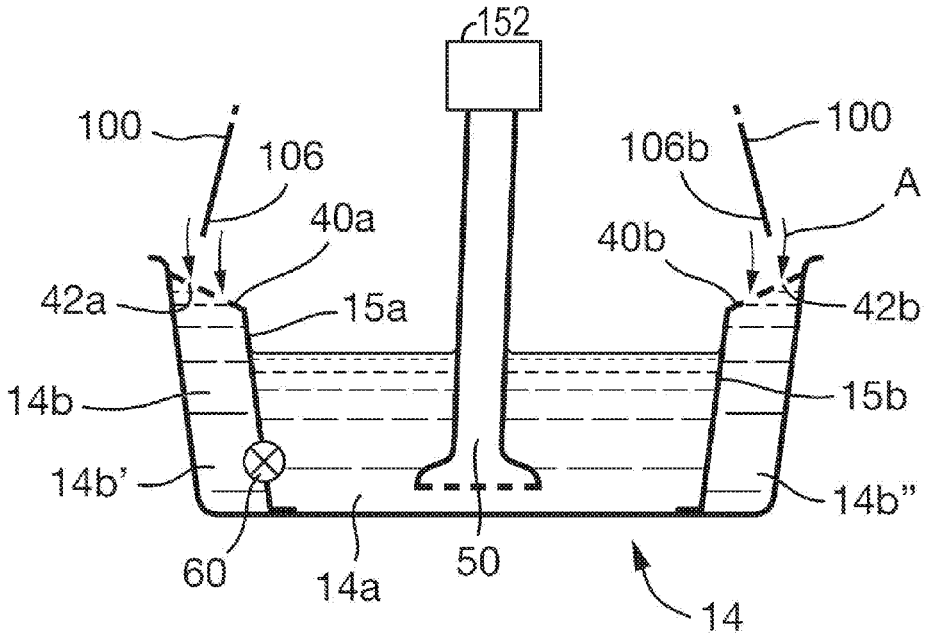
FIG. 6 shows a sectional view of a crankcase sump arrangement according to an example of the present disclosure.

Referring now to FIG. 6, an arrangement of the sump portion 14 will be described. As depicted, the sump portion 14 includes a primary sump volume 14*a* and a secondary sump volume 14*b*. The secondary sump volume 14*b* may be divided into first and second secondary sump portions 14*b*' and 14*b*", which may be provided either side of the primary sump volume 14*a*. The first and second secondary sump portions 14*b*' and 14*b*" may be in fluidic communication with each other, e.g., in a plane behind that depicted in FIG. 6.

The primary and secondary sump volumes 14*a*, 14*b* are separated by first and second dividing walls 15*a*, 15*b*. The first dividing wall 15*a* separates the primary sump volume 14*a* from the first secondary sump portion 14*b*' and the second dividing wall 15*b* separates the primary sump volume from the second secondary sump portion 14*b*". The first and second dividing walls 15*a*, 15*b* may extend in a direction substantially parallel to the crankshaft longitudinal axis 6*a*. The dividing walls 15*a*, 15*b* may extend to a height that is substantially equal to the standard fill level for the oil.

As depicted, one or more crankcase oil catchers 100 are arranged with their bottom edges 106 arranged above the secondary sump volume 14*b*. In particular, a first bottom edge 106*a* on one side of the crankcase oil catcher 100 may be arranged above the first secondary sump portion 14*b*' and a second bottom edge 106*b* on the other side of the crankcase oil catcher 100 may be arranged above the second secondary sump portion 14*b*".

Referring still to FIG. 6, first and second guides 40*a*, 40*b* may be provided. The guides are provided to direct oil to the primary sump portion 14*a* during engine warm up, to increase the temperature of the oil, to decrease friction losses. The guides 40*a*, 40*b* may be provided beneath the bottom edges 106*a*, 106*b* of the crankcase oil catchers so that oil falling from the bottom edge of the crankcase oil catchers may drop onto the guides. (The oil flow is denoted by arrows A). In particular, the guides 40*a*, 40*b* may be positioned between the crankcase oil catcher bottom edges 106*a*, 106*b* and the corresponding first and second secondary sump portions 14*b*', 14*b*".

The first and second guides 40*a*, 40*b* may be configured to collect and guide oil captured by the crankcase oil catchers 100 into the primary sump volume 14*a*. For example, the first and second guides 40*a*, 40*b* may be angled relative to a horizontal plane and extend such that collected oil flows towards the primary sump volume 14*a*. In particular, the guides 40*a*, 40*b* may be angled with one side of the guide higher than the side of the guide that is closest to the primary sump volume 14*a*.

An edge of the guides 40*a*, 40*b* may be connected to a top edge of the respective dividing walls 15*a*, 15*b*. In particular, the guides 40*a*, 40*b* may be integral with the respective dividing walls 15*a*, 15*b*.

As mentioned above, the crankcase assembly 150 may include a plurality of crankcase oil catchers 100, e.g., one for each cylinder 10 and piston 12 of the engine. The guides may extend across the bottom of each of these crankcase oil catchers. Accordingly, the guides 40*a*, 40*b* may be elongated and may extend in a direction parallel to the crankshaft longitudinal axis 6*a*.

As depicted, the guides 40*a*, 40*b* may include one or more openings 42*a*, 42*b* configured to allow hot oil to pass through to the first and second secondary sump portions 14*b*', 14*b*" beneath. The openings 42*a*, 42*b* may be sized such that oil does not pass through openings when the oil is below a threshold temperature, e.g., by virtue of the higher viscosity at lower temperatures. The openings 42*a*, 42*b* may be formed from a mesh or perforations. The openings 42*a*, 42*b* enable higher viscosity oil to be directed to the primary sump volume 14*a* during engine warm up and enable lower viscosity oil to be direct to the secondary sump portions 14*b*', 14*b*" subsequent to engine warm up (e.g., when the engine has surpassed a predetermined threshold temperature.) As a result, lubrication oil may be heated more quickly during engine warm up while reducing oil heating subsequent to warm up to prevent the oil from surpassing a desired temperature. Consequently, engine lubrication may be improved during warm up without compromising engine lubrication subsequent to warm up.

An oil pump pick-up 50 may be provided in the primary sump volume 14*a* to collect oil from the primary sump volume for an oil pump 152.

The crankcase assembly 150 may further include a valve 60 provided in one or both of the first and second dividing walls 15*a*, 15*b*. The valve 60 may be configured to selectively permit the flow of oil between the primary and secondary sump volumes 14*a*, 14*b*. The valve 60 may be a thermostatic valve that automatically opens at a certain temperature. Alternatively, the valve 60 may be operatively connected to a controller, which sends a signal to open the valve when a sensor (not shown) indicates to the controller that the oil has reached a threshold temperature, for example 115° C.

In one example, the valve 60 may otherwise be opened in any of the following circumstances:

1. If the oil level at the oil pump pick-up 50 is low, even if the oil is cold, to avoid oil starvation. This could be determined by an oil level sensor, oil pressure sensor or both.

2. During power off or engine shut down. This allows the engine to be filled with oil and drained without any issues. It also allows a levelling of oil during drain down and oil to interchange between the two volumes.

3. It may also be advantageous to periodically open the valve 60 (for example, once in every 20 warm-up occurrences) if the engine does not warm up fully to allow the exchange of oil between the primary and secondary volumes.

Figure 7:
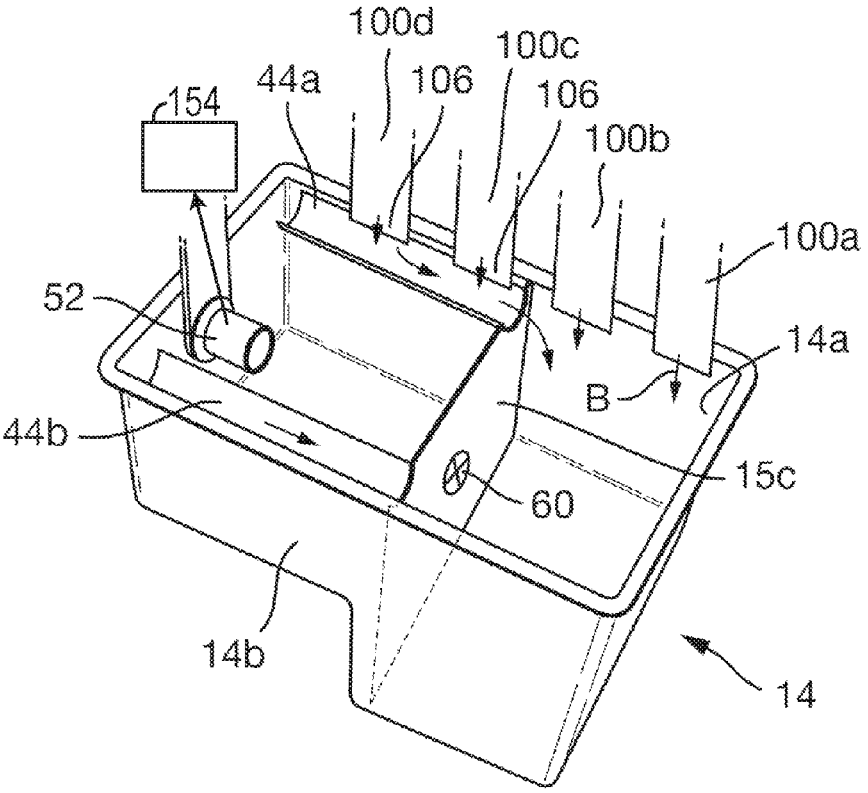
FIG. 7 shows a perspective view of a crankcase sump arrangement according to a further example of the present disclosure.

FIG. 7 shows an alternative arrangement of the sump portion 14. In contrast to the arrangement depicted in FIG. 6, the primary and secondary sump volumes 14*a*, 14*b* are separated by a single dividing wall 15*c*. The dividing wall 15*c* extends in a direction substantially perpendicular to the crankshaft longitudinal axis 6*a*. The primary sump volume 14*a* may also extend to a greater depth than the secondary sump volume 14*b*. Furthermore, the dividing wall 15*c* may extend to a height that is substantially equal to the standard fill level for the oil.

As depicted in FIG. 7, a first set, e.g., pair, of crankcase oil catchers 100*a*, 100*b* may be provided above the primary sump volume 14*a* and may thus guide oil directly into the primary sump volume 14*a*. By contrast, a second set, e.g., pair, of crankcase oil catchers 100*c*, 100*d* may be provided above the secondary sump volume. A pair of guides 44*a*, 44*b* may extend beneath the bottom edges 106 of the second set of crankcase oil catchers 100*c*, 100*d* so as to collect oil falling from the bottom edges. (The oil flow is denoted by arrows B). The guides 44*a*, 44*b* are provided either side of the crankshaft and extend in a direction substantially parallel to the crankshaft longitudinal axis 6*a*. (NB, for the sake of clarity only one side of each crankcase oil catcher 100 is depicted in FIG. 7.)

The pair of guides 44*a*, 44*b* may be configured to direct oil into the primary sump volume 14*a*. In particular, the guides 44*a*, 44*b* may be angled relative to a horizontal plane (when installed) so that oil falls towards the primary sump volume 14*a*. The guides 44*a*, 44*b* may be angled with one end of the guide higher than the end of the guide that is closer to the primary sump volume 14*a*.

In contrast to the guides 40*a*, 40*b* depicted in FIG. 6, which may be substantially flat, the guides 44*a*, 44*b* may form a channel. For example, the guides 44*a*, 44*b* may be curved, e.g., within a cross section in the plane perpendicular to the crankshaft longitudinal axis 6*a*. Alternatively, the guides 44*a*, 44*b* may include sidewalls extending in the longitudinal direction, e.g., so as to form a gulley. In either case, the channel shape of the guides 44*a*, 44*b* may help to prevent oil falling from the guides into the secondary sump volume 14*b*.

An end of the guides 44*a*, 44*b* may be connected to a top edge of the dividing wall 15*c*. As for the arrangement shown in FIG. 6, the guides may be integral with the dividing wall 15*c*. Alternatively, the guides 44*a*, 44*b* may be separate components that may for example be connected to the sump walls 20. In a further alternative, the guides 44*a*, 44*b* may be connected to the bottom of the crankcase oil catchers 100.

As for the arrangement shown in FIG. 7, the guides 44*a*, 44*b* may have one or more openings (not shown) configured to allow hot oil to pass through to the secondary sump portion 14*b* beneath. The openings may be sized such that oil does not pass through openings when the oil is below a threshold temperature, e.g., by virtue of the higher viscosity at lower temperatures. The openings may be formed from a mesh or perforations.

Again, as for the arrangement shown in FIG. 7, the valve 60 may be provided in the dividing wall 15*c* to selectively permit flow between the primary and secondary sump volumes 14*a*, 14*b*. The valve 60 may function in the same way as described above.

An oil pump pick-up 52 of an oil pump 154 may be provided in the secondary sump volume 14*b*. Accordingly, leakage from the oil pump may collect in the secondary sump volume. This may help promote exchange of oil between the two sump volumes. However, to avoid the pump running dry, an oil pump pick-up (not shown) may be provided in the primary sump volume 14*a* to collect oil from the primary sump volume for an oil pump. In such an example, the oil pump pick-ups in both the primary sump volume 14*a* and the secondary sump volume 14*b* may be connected to a single oil pump. However, in other examples the oil pump pick-ups may be connected to separate oil pumps.

In either of the arrangements depicted in FIGS. 6 and 7, the guides and/or dividing walls may be made from a thermally insulating material, for example a plastic such as nylon.

With the arrangements depicted in FIGS. 6 and 7, oil may be returned to the primary sump volume 14*a* during warm-up of the engine. Restricting the initial volume of the sump to the primary sump volume 14*a* may increase the rate at which the engine warms up by reducing the exposure of the oil to the thermal mass of the sump walls. As a result, the oil has a lower viscosity during warm-up, which leads to lower friction losses in the engine. This in turn leads improved combustion efficiency, fuel economy, and cabin heating.

The combination of the above-described guides and crankcase oil catchers helps to increase the amount of oil returned to the primary volume. Once the engine has warmed up, the valve 60 may open and the primary and secondary sump volumes may effectively be combined. The openings 42*a*, 42*b* may also begin to permit flow into the secondary sump volume 14*b*. Greater cooling of the oil may then be achieved through the increased exposure to the sump walls 20.

The subject matter of the present disclosure is further described in the following paragraphs. According to one aspect, a crankcase assembly for an engine, including a crankcase comprising a crank sump, the crank sump including a primary sump volume and a secondary sump volume, one or more crankcase oil catchers, the crankcase oil catchers comprising one or more surfaces configured to catch dispersed oil in the crankcase and direct the oil along the surfaces of the crankcase oil catcher away from a crankcase casing wall and towards the crank sump, wherein the crankcase oil catchers are provided above a crankshaft and below an associated piston of the engine, and one or more guides configured to collect oil captured by the crankcase oil catchers and guide the oil to the primary sump volume.

In any of the aspects described herein or combinations of the aspects, the one or more guides may extend in a direction parallel to a longitudinal axis of the crankshaft.

In any of the aspects described herein or combinations of the aspects, the crankcase assembly may further include a plurality of crankcase oil catchers.

In any of the aspects described herein or combinations of the aspects, the one or more guides may extend across one or more of the plurality of crankcase oil catchers.

In any of the aspects described herein or combinations of the aspects, the one or more guides may extend across the plurality of crankcase oil catchers.

In any of the aspects described herein or combinations of the aspects, one or more first crankcase oil catchers may guide oil directly into the primary sump volume and one or more second crankcase oil catchers may be provided above the secondary sump volume, wherein the one or more guides may extend across the second crankcase oil catchers so as to direct oil into the primary volume.

In any of the aspects described herein or combinations of the aspects, the one or more guides may be provided beneath a bottom edge of the crankcase oil catchers such that oil falling from the bottom edge of the crankcase oil catchers drops onto the one or more guides. In any of the aspects described herein or combinations of the aspects, the one or more guides may include a pair of guides with one guide either side of the crankshaft.

In any of the aspects described herein or combinations of the aspects, the one or more guides may be integral with a wall dividing the primary and secondary sump volumes.

In any of the aspects described herein or combinations of the aspects, the one or more guides may include one or more openings configured to allow hot oil to pass through to the secondary sump volume beneath, the openings may be sized such that oil does not pass through openings when the oil is below a threshold temperature.

In any of the aspects described herein or combinations of the aspects, the openings may be formed from a mesh or perforations.

In any of the aspects described herein or combinations of the aspects, oil may be returned to the primary sump volume during warm-up of the engine.

In any of the aspects described herein or combinations of the aspects, an oil pump may be provided in or above the secondary sump volume such that leakage from the oil pump collects in the secondary sump volume.

In any of the aspects described herein or combinations of the aspects, an oil pump pick-up may be provided in the primary sump volume to collect oil from the primary sump volume for an oil pump.

In any of the aspects described herein or combinations of the aspects, the crankcase assembly may further include a valve provided between the primary and secondary sump volumes, the valve being configured to selectively permit the flow of oil between the primary and secondary sump volumes.

In any of the aspects described herein or combinations of the aspects, the crankcase oil catchers may include a first aperture for a connecting rod to pass through.

In any of the aspects described herein or combinations of the aspects, the crankcase oil catchers may be spaced apart from the crankcase casing wall.

In any of the aspects described herein or combinations of the aspects, each crankcase oil catcher may be configured to be provided for a single cylinder of an engine.

In any of the aspects described herein or combinations of the aspects, the crankcase oil catchers and/or guides may be made from a thermally insulating material.

In any of the aspects described herein or combinations of the aspects, the crankcase oil catchers and/or one or more guides may be made at least in part from a plastic material.

It will be appreciated by those skilled in the art that although the invention has been described by way of example with reference to one or more examples, it is not limited to the disclosed examples and that alternative examples could be constructed without departing from the scope of the invention as defined by the appended claims.

The figures herein show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that the configurations and routines disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. Further, one or more of the various system configurations may be used in combination with one or more of the described diagnostic routines. The subject matter of the present disclosure includes all novel and non-obvious combinations and sub-combinations of the various systems and configurations, and other features, functions, and/or properties disclosed herein.

The invention claimed is:

1. A crankcase assembly for an engine, comprising:

a crankcase comprising a crank sump, the crank sump including a primary sump volume and a secondary sump volume;

one or more crankcase oil catchers, the crankcase oil catchers comprising one or more surfaces configured to catch dispersed oil in the crankcase and direct the oil along the surfaces of the crankcase oil catcher away from a crankcase casing wall and towards the crank sump, wherein the crankcase oil catchers are provided above a crankshaft and below an associated piston of the engine; and one or more guides configured to collect oil captured by the crankcase oil catchers and guide the oil to the primary sump volume.

2. The crankcase assembly of claim 1, wherein the one or more guides extend in a direction parallel to a longitudinal axis of the crankshaft.

3. The crankcase assembly of claim 1, further comprising a plurality of crankcase oil catchers.

4. The crankcase assembly of claim 3, wherein the one or more guides extend across one or more of the plurality of crankcase oil catchers.

5. The crankcase assembly of claim 3, wherein the one or more guides extend across the plurality of crankcase oil catchers.

6. The crankcase assembly of claim 3, wherein one or more first crankcase oil catchers guide oil directly into the primary sump volume and one or more second crankcase oil catchers are provided above the secondary sump volume, wherein the one or more guides extend across the second crankcase oil catchers so as to direct oil into the primary volume.

7. The crankcase assembly of claim 1, wherein the one or more guides are provided beneath a bottom edge of the crankcase oil catchers such that oil falling from the bottom edge of the crankcase oil catchers drops onto the one or more guides.

8. The crankcase assembly of claim 1, wherein the one or more guides include a pair of guides with one guide either side of the crankshaft.

9. The crankcase assembly of claim 1, wherein the one or more guides are integral with a wall dividing the primary and secondary sump volumes.

10. The crankcase assembly of claim 1, wherein the one or more guides include one or more openings configured to allow hot oil to pass through to the secondary sump volume beneath, the openings being sized such that oil does not pass through openings when the oil is below a threshold temperature.

11. The crankcase assembly of claim 10, wherein the openings are formed from a mesh or perforations.

12. The crankcase assembly of claim 1, wherein oil is returned to the primary sump volume during warm-up of the engine.

13. The crankcase assembly of claim 1, wherein an oil pump is provided in or above the secondary sump volume such that leakage from the oil pump collects in the secondary sump volume.

14. The crankcase assembly of claim 1, wherein an oil pump pick-up is provided in the primary sump volume to collect oil from the primary sump volume for an oil pump.

15. The crankcase assembly of claim 1, further comprising a valve provided between the primary and secondary sump volumes, the valve being configured to selectively permit the flow of oil between the primary and secondary sump volumes.

16. The crankcase assembly of claim 1, wherein the crankcase oil catchers comprise a first aperture for a connecting rod to pass through.

17. The crankcase assembly of claim 1, wherein the crankcase oil catchers are spaced apart from the crankcase casing wall.

18. The crankcase assembly of claim 1, wherein each crankcase oil catcher is configured to be provided for a single cylinder of an engine.

19. The crankcase assembly of claim 1, wherein the crankcase oil catchers and/or guides are made from a thermally insulating material, and wherein the crankcase oil catchers and/or one or more guides are made at least in part from a plastic material.

20. A engine, comprising:

a crankcase comprising a crank sump with first and second separate distinct sump volumes;

oil catchers having surfaces positioned to catch dispersed oil in the crankcase and direct the oil away from a crankcase casing wall and towards the crank sump, the oil catchers positioned above a crankshaft and below engine pistons; and guides shaped to collect and guide oil to the first, and not the second, sump volume.

* * * * *